US005311798A

United States Patent [19]

Trusky

[11] Patent Number: 5,311,798

[45] Date of Patent: May 17, 1994

[54] SPRING SPREADING TOOL

[76] Inventor: Michael T. Trusky, 205 Idaho, Laredo, Tex. 78041

[21] Appl. No.: 954,939

[22] Filed: Sep. 30, 1992

Related U.S. Application Data

[63] Continuation of Ser. No. 503,841, Apr. 2, 1990, abandoned.

[51] Int. Cl.[5] ..... B25B 7/00

[52] U.S. Cl. ..... 81/485; 81/422; 81/302

[58] Field of Search ..... 81/302, 389, 418–424, 81/424.5, 426, 485, 486; 29/225, 227, 229, 239, 268; 269/261, 262, 282, 283, 284

[56] References Cited

U.S. PATENT DOCUMENTS

| | | | |
|---|---|---|---|
| 1,862,326 | 6/1932 | Altice | 29/227 |
| 1,917,878 | 7/1933 | O'Donnell | 29/227 |
| 1,938,102 | 12/1933 | Hill | 29/227 |
| 1,951,953 | 3/1934 | Tollonitsch | 29/268 |
| 1,953,930 | 4/1936 | Dyal | 29/227 |
| 2,329,591 | 9/1943 | Christian | 29/227 |
| 2,522,611 | 9/1950 | Guth | 29/227 |
| 2,716,273 | 8/1955 | Woodruff et al. | 81/418 X |
| 2,802,383 | 8/1957 | Babyak | 81/485 X |
| 3,292,250 | 12/1966 | Miller | 29/227 |
| 3,446,102 | 5/1969 | Hallmark | 81/422 X |
| 3,540,106 | 11/1970 | Goldman | 81/302 X |
| 4,027,556 | 6/1977 | Klein et al. | 29/268 X |
| 4,050,464 | 9/1977 | Hall | 81/302 X |
| 4,197,647 | 4/1980 | Goldenthal | 81/421 X |

*Primary Examiner*—D. S. Meislin

*Attorney, Agent, or Firm*—Mark A. Montgomery

[57] ABSTRACT

A tool for spreading high tension springs used in the brakes of heavy equipment is provided. This tool spreads at least a portion of a high tension spring by squeezing the handles together by hand thereby separating the arms. This is the opposite of what happens when the handles of standard pliers are squeezed together.

12 Claims, 3 Drawing Sheets

SPRING SPREADING TOOL

This is a continuation of copending application Ser. No. 07/503,841 filed on Apr. 2, 1990, now abandoned.

This invention relates to a spring spreading tool and the method for using this tool, such as in the installation of high tension helical springs on the brakes of heavy equipment.

BACKGROUND OF THE INVENTION

In certain applications it would be very beneficial to be able to mechanically extend or spread a spring. High tension helical springs used on the brakes of heavy equipment are very difficult to stretch by hand. However, no conventional tool is capable of spreading such springs. Tools made for standard helical springs tend to break or bend in attempting to spread high tension helical springs and any tool capable of stretching these springs cannot easily install them on the brake shoes.

Conventional methods of reinstalling brake shoes on heavy equipment is time consuming and very difficult for the sole mechanic due to the relative difficulty of stretching the brake shoe return springs. However, brake pads do wear out and must be replaced quite often on heavy equipment, particularly with the advent of non-asbestos brake pads. Therefore, mechanics must by some method frequently reinstall brake shoes with new brake pads.

One method of reinstalling brake shoes entails installing the return springs on the pair of brake shoes prior to installing the brake shoes on the backing plate of the brake assembly. This then requires the mechanic to lift the joined pair of brake shoes onto the backing plate while aligning the backing plate pins, S cam, rollers, and springs. A pair of brake shoes generally has a mass of well over 20 kilograms (44 pounds), in some cases over 40 kilograms. Lifting and aligning both brake shoes together is a very difficult task for a sole mechanic.

Another method of reinstalling brake shoes entails installing one brake shoe at a time on the backing plate then attaching the brake return spring to each brake shoe with the rollers removed (rollers not against the S cam). This then requires the mechanic to pull on each brake shoe by hand (thereby stretching the brake return spring) and drop the rollers into the notch in each brake shoe and against the S cam. This is very difficult, particularly while dropping the last roller into the notch. Many times this procedure results in smashed finger tips as the mechanic releases the brake shoe.

It would be very desirable to be able to install brake shoes quickly and easily without encountering the above problems. More particularly, it would be very desirable to be able to mechanically stretch the brake return spring and attach it to each brake shoe.

SUMMARY OF THE INVENTION

According to one aspect of the present invention, a tool for spreading high tension springs comprises a first lever and a second lever opposed thereto, each lever having a handle at the bottom end, an arm at the top end, and an intermediate region at which the levers are hinged to each other by a pivot means, the end of the first arm of said first lever having a first means to hold the curved end or hook of a helical spring, the end of the second arm of said second lever having a second means to hold a separate section of said spring, said separate section being stretchable away from said curved end, the handle and arm of each lever being on the same side of said pivot means, the arrangement being such that said handles are squeezed together to spread said arms that stretch said spring, said arms being capable of withstanding a force of 100 pounds (445 newtons) in the direction of movement.

According to another aspect of the present invention, a process of installing brakes on heavy equipment comprises; (a) setting one brake shoe on the backing plate of a brake assembly, (b) setting the other brake shoe on said backing plate, (c) attaching one hook of the brake return spring to one brake shoe, (d) spreading said spring, and (e) attaching the other hook of said spring to the other brake shoe while the brake shoe rollers are against the S cam.

DETAILED DESCRIPTION OF THE INVENTION

Figure 1:
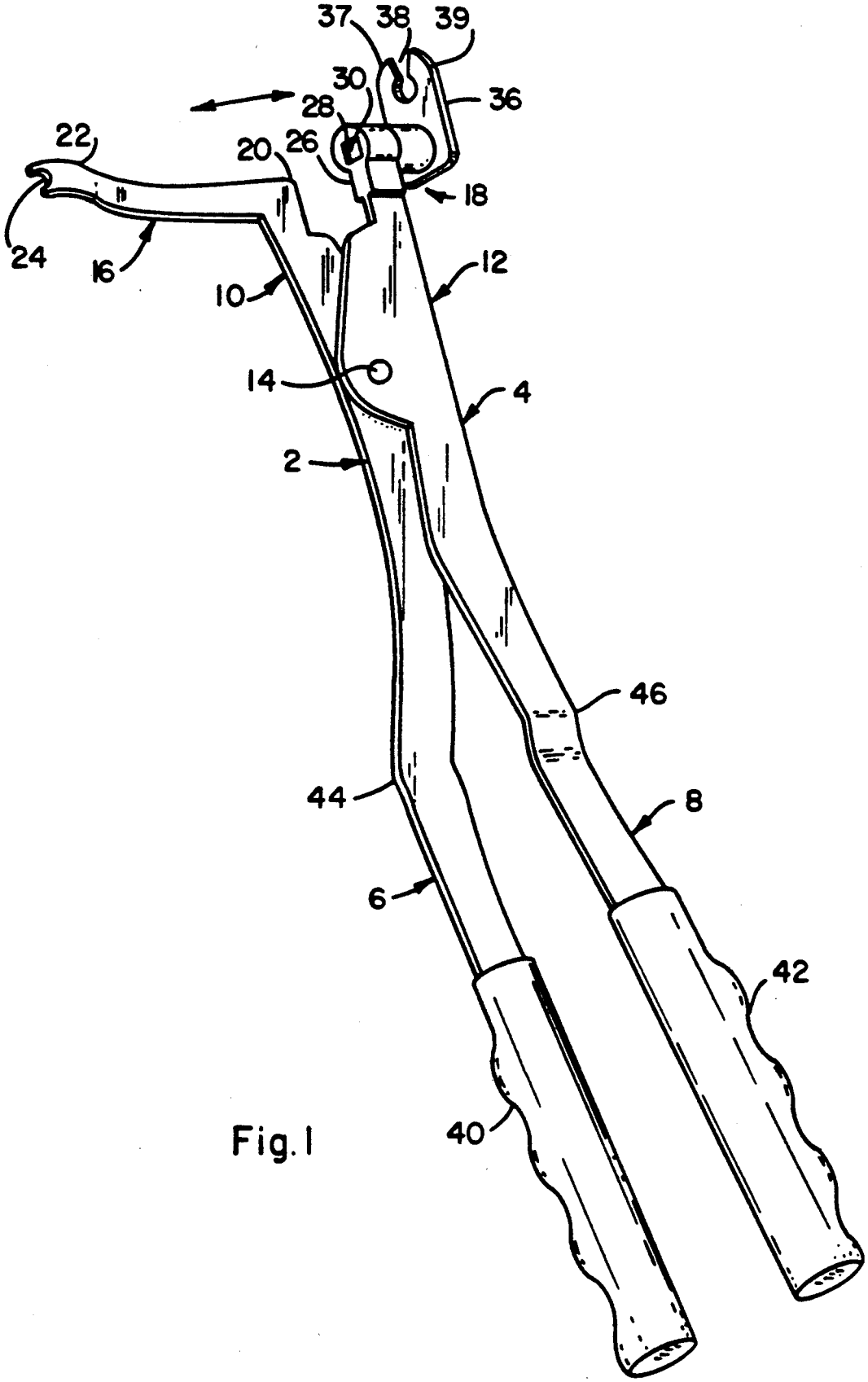
FIG. 1 is a pictorial representation illustrating the tool of the present invention.

With reference to FIG. 1, the tool of the present invention comprises a first lever 2 having a handle 6 at one end and an arm 10 at the other end, and a second lever 4 opposed to the first lever 2 having a handle 8 at one end and an arm 12 at the other end with an intermediate region at which the levers are joined and hinged to each other by a pivot means 14. The handle and arm of each lever are on the same side of the pivot means 14 such that the squeezing of the handles together spreads the arms. Both handles 6 and 8 are on the same end of the tool and both arms 10 and 12 are on the other end. In this figure the handles are on the bottom of the tool and the arms are on the top of the tool. The ends 40 and 42 of handles 6 and 8 respectively are preferably adapted to fit the hand and preferably have finger depressions and are covered with a non-slip material. This non-slip material can be any conventional material such as a rubbery plastic material and is coated on ends 40 and 42 by any conventional method such as by dipping in a liquid or molten plastic. The ends of handles 6 and 8 are preferably in the same plane and are preferably bent at 44 and 46 respectively to accomplish this.

Figures 2, 3:
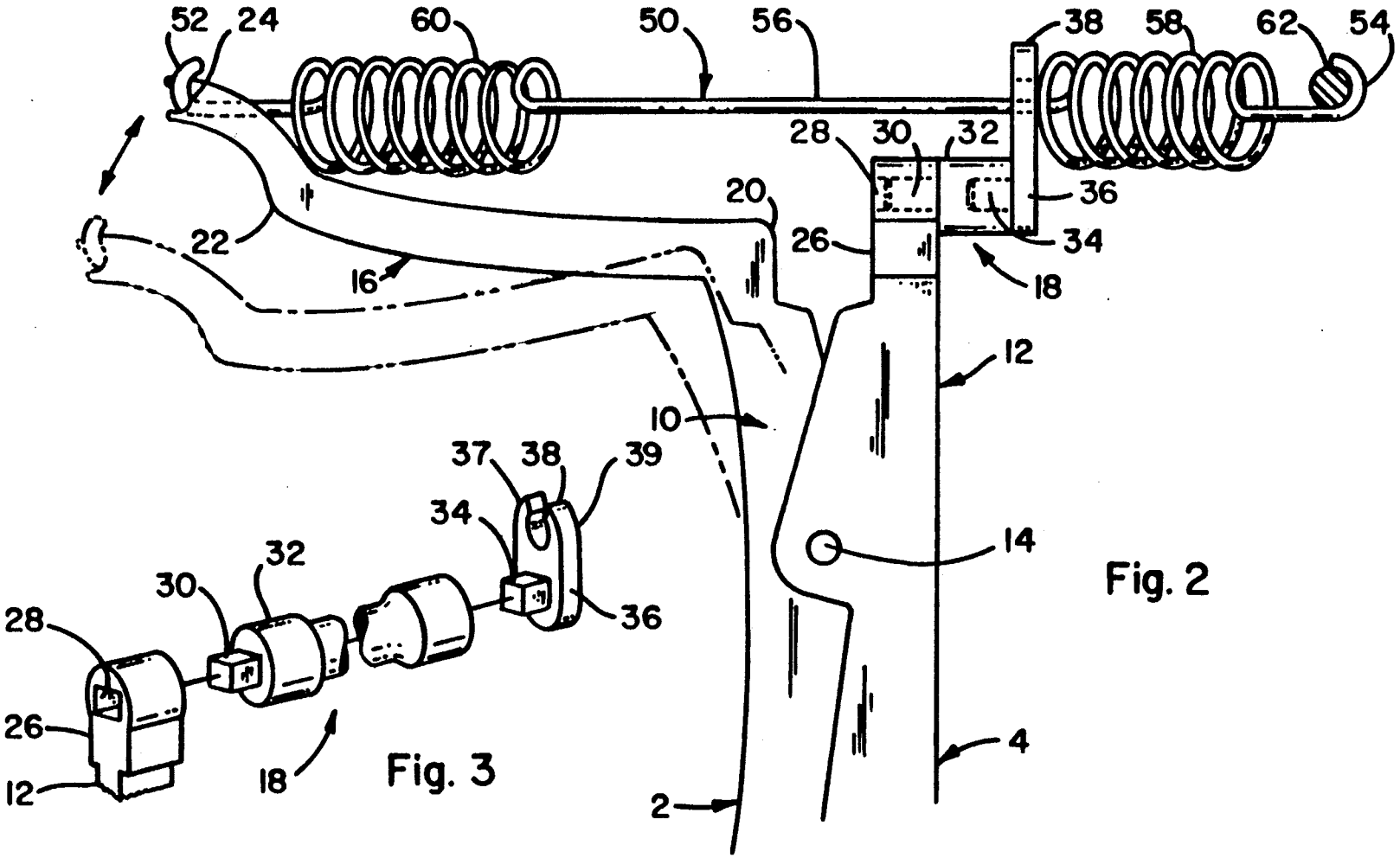
FIG. 2 is a view of the upper portion of the tool of the present invention as it stretches a high tension helical spring.
FIG. 3 is an expanded view of a portion of the right (second) arm and the means of holding a portion of a spring.

As shown in FIG. 2, the arm of each lever has a means to hold a portion of a spring. Arm 10 of the first lever 2 has a first means 16 at its end and arm 12 of the second lever 4 has a second means 18 at its end.

Means 16 preferably comprises the end of the first arm 10 bent at 20 extending generally in the direction of movement away from the body of the first lever 2, preferably perpendicular to the body of the first lever. Arm 10 can be bent at 20, but means 16 is preferably a separate piece that is attached to arm 10, such as by spot welding. The very end 24 of means 16 has a notch therein to hold the curved end or hook 52 of a helical spring 50. Means 16 preferably has a crook 22 near the very end 24, slightly bending the very end 24 up and away from handle 6. This crook 22 provides clearance above means 16 of the first arm 10 for the coils 60 in the body of a helical spring 50.

Means 18 comprises the end of the second arm 12 adapted to hold a separate section of a helical spring. This separate section is capable of being stretched or extended under axial tension away from the hook 52 that is held by means 16. As best shown in FIGS. 1 and 3 means 18 preferably comprises a flat plate 36 that has a slot 38 cut in the top in the direction of movement. Slot 38 has a left side 37 and a right side 39. The wire 56 of a double coil spring 50 fits into slot 38 between 37 and 39. Means 18 preferably holds one set of coils 58 of a double coil spring 50. Plate 36 is preferably inserted between the two sets of coils 60 and 58 of said spring and is against the set of coils 58.

Referring to FIG. 3, plate 36 is detachable from the body of the second arm 12 having a shank 34 extending in the direction of movement towards the body of the second arm. Shank 34 fits into a non-round hole 28 in the body of the second arm 12. Shank 34 and hole 28 are preferably square. Hole 28 is preferably in head 26 that can be formed in the end of arm 12 of lever 4, such as by forming a hole in the end of arm 12 when lever 4 is stamped out then twisting the hole so its axis is in the direction of movement. Head 26 is more preferably formed independent of arm 12 and is attached to the end of arm 12 such as by means of a spot weld. Since plate 36 is detachable from arm 12 and head 26, extensions such as extension 32 can be used to extend plate 36 along the axis of shank 34. The extensions enable the tool of the present invention to stretch springs of many lengths. Shank 34 and shank 30 of extension 32 are preferably of standard dimension so as to fit extensions found in a mechanics tool box such as 3/8 inch extensions. Shanks 34 and 30 are securely fastened into the receiving holes but are removable by the exertion of a small amount of force. Shanks 34 and 30 are preferably fastened to the holes by a friction or snap means such as a standard snap fitting (not shown) in which a spring causes a portion of a ball to protrude out of one side of the shank. The ball then fits into a depression in the wall of the hole. Plate 36 is incapable of rotation during use but could be attached to a threaded shank 34 (not shown) that is incrementally adjustable along the direction of movement but locked into position by a lock nut during spring stretching.

Plate 36 can be removed and less preferably exchanged with some other end (not shown) to fit some other part or portion of a spring.

The tool of the present invention preferably only stretches part of a spring, more preferably only one set of coils of a double coil brake spring as illustrated in FIG. 2. The tool of the present invention preferably stretches a spring a distance of at least about ½ inch (about 1 cm), more preferably at least about 1 inch (about 2 cm).

The tool of the present invention is so constructed that each arm is capable of withstanding a force of at least 100 pounds (445 newtons(N) in the direction of movement. If the tool were held in a horizontal position each arm could hold a 100 pound (45 kilogram) weight in the direction of compression (direction that pushes the arms together). The tool is more preferably constructed such that each arm is capable of withstanding a force of at least 200 pounds (890N) in the direction of compression such that the tool is capable of spreading springs that require a force of 200 pounds (890N) to extend the spring ½ inch to 1 inch (1-2 cm) under axial tension. The tool of the present invention is most preferably constructed to be able to extend springs that require a force of at least 300 pounds (1334N) to extend the spring ½ inch to 1 inch (1-2 cm) under axial tension.

The tool of the present invention is preferably substantially flat (save the very end of the second means) being at least twice as thick in the direction of movement. This gives the tool the most strength in the direction of movement. The tool of the present invention is constructed out of any suitable strong material, preferably steel. The tool is more preferably stamped out of a sheet of material such as a thick sheet of stainless steel.

The tool of the present invention preferably has only one pivot point 14 and in operation radially stretches a spring as illustrated in FIG. 2 in a non-linear movement. The pivot means is closer to the top of the tool than the bottom. The arms of the tool are preferably less than one half the length of the handles, measuring from the top to the bottom and not side to side. This enables the mechanic to stretch higher tension springs, by use of the levers, than would normally be possible if the arms and handles were the same length. Stating this another way, if a line or vector is drawn in the direction of the force that the spring exerts on the ends of the arms the point that this line is the closest to pivot means 14 is less than one half the distance from the pivot means 14 to the point at the very end of the handles. This distance or length of the arms is more preferably less than one third the length of the handles, most preferably less than one quarter the length of the handles.

The tool of the present invention is preferably constructed such that an average man can squeeze the handles and stretch a high tension spring used in brake shoes of heavy equipment such as tractor trailers. The tool of the present invention is more preferably constructed such that the average man can do this with one hand.

Figure 4:
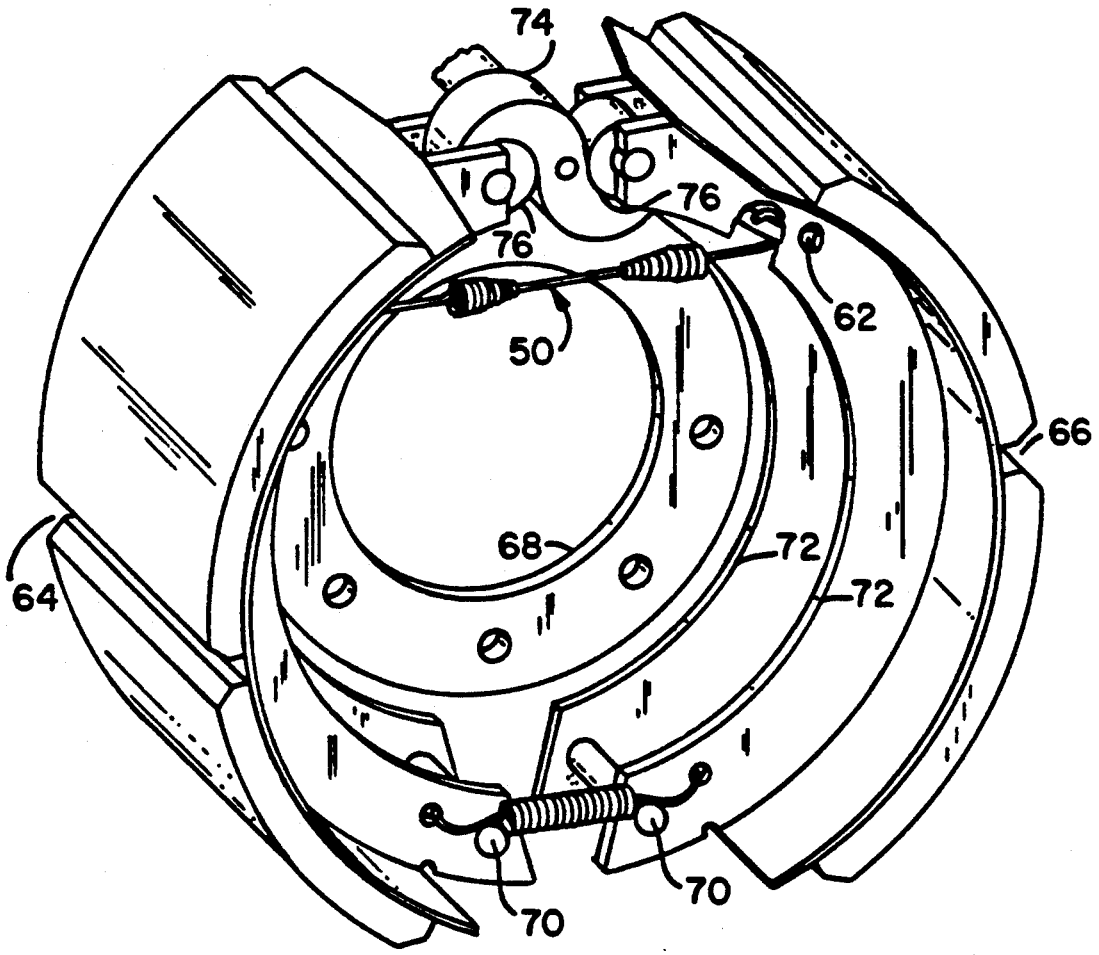
FIG. 4 is a pictorial representation of a pair of brake shoes installed against a backing plate of a brake assembly.

The process of installing brakes according to the present invention entails, referring to FIG. 4, setting one brake shoe (either brake shoe 64 or 66) on the backing plate 68 of the total brake assembly (not shown). The hole in the bottom of the brake shoe is slid onto one of the pins 70. On some brake shoes there is just a notch and one pin (not shown). The other brake shoe is then set on the backing plate. The rollers 76 are now in position against the S cam 74. One end or hook of the spring is hooked onto the pin 62 and then the tool is moved into position as shown in FIG. 2. The spring is then spread by squeezing the handles of the tool and the other hook is attached to the other pin on the other brake shoe (not shown). As can be seen in FIG. 4, brake shoes used on heavy equipment generally have two webs 72. This double web makes it very difficult to install brake shoes and attach the spring between the double web using conventional methods. The very end 24 of the tool is preferably thin such that it easily fits between these two webs 72 while holding the hook 52 of the spring.

The invention has been described in detail with particular reference to preferred embodiments thereof, however, variations and modifications can be made without departing from the scope of the present invention.

I claim:

1. A tool for spreading high tension springs comprising a first level and a second level opposed thereto, each level having a handle at the bottom end, an arm at the top end, and an intermediate region at which the levers are hinged to each other by a pivot means having a pivot axis about which the levers pivot, an end of the arm of said first lever having a first means to hold a hook of a helical spring said first means extending perpendicular to said first lever generally in a plane in which said first lever pivots, an end of the arm of said second lever having a second means to hold a separate section of said spring, said second means having a slot cut in its top said slot lying perpendicular to a plane in which said second lever pivots, said second means having a right side and a left side extending above and below the plane in which said second lever pivots; the separate section of said spring being stretchable away from said hook, the handle and arm of each lever being on the same side of said pivot means, the arrangement being such that the handles are squeezed together to spread the arms to stretch said spring; wherein said second means is detachable from the end of the arm of said second lever having a shank extending towards the end of the arm of said second lever further comprising an extension between the end of the arm of said second lever and said second means, said shank fitting into a non-round hole in said extension which fits into a non-round hole in the end of the arm of said second lever.

2. The tool of claim 1 wherein said second means is adjustable along said shank by a threaded screw means that is locked into position by a lock nut during spring stretching.

3. The tool of claim 1 wherein the ends of said handles have finger depressions and are covered with a non-slip material.

4. The tool of claim 1 wherein said arms of said tool spread about ½ inch to 1 inch during use and said arms are less than one third the length of said handles.

5. The tool of claim 1 wherein said pivot means has only one pivot point.

6. The tool of claim 1 wherein said levers are substantially flat lying in the plane in which each lever pivots.

7. An article of manufacture comprising the tool of claim 1 produced from steel.

8. The tool of claim 1 wherein the very end of said first means is flat having a notch therein to fit the hook of said spring.

9. The tool of claim 8 wherein said first means that extends perpendicular to said first lever has a crook near the very end, slightly bending the very end up and away from the handle of said first lever to provide clearance above said first means for the coils of a spring body.

10. The tool of claim 1 wherein said second means fits between the coils of a double coil spring holding one coil of said double coil spring, said slot engaging the wire between the coils and said second means is non-rotatable during use.

11. The tool of claim 1 wherein said shank and said hole are square, said shank and said hole being removably joined.

12. The tool of claim 11 wherein said shank and said hole are joined by a means selected from the group consisting of a snap means and a friction means.

* * * * *